United States Patent [19]

Pops

[11] Patent Number: 4,826,544

[45] Date of Patent: May 2, 1989

[54] HYDROGEN CLEANING OF HOT COPPER ROD

[75] Inventor: Horace Pops, Fort Wayne, Ind.

[73] Assignee: Essex Group, Inc., Fort Wayne, Ind.

[21] Appl. No.: 136,796

[22] Filed: Dec. 22, 1987

[51] Int. Cl.[4] ..... C01G 25/00

[52] U.S. Cl. ..... 148/13.2; 148/20.3

[58] Field of Search ..... 148/13.2, 20.3

[56] References Cited

U.S. PATENT DOCUMENTS

| | | | |
|---|---|---|---|
| 1,905,809 | 4/1933 | Cowar | 148/13.2 |
| 3,257,835 | 6/1966 | Cofer et al. | 72/364 |
| 3,296,682 | 1/1967 | Cofer et al. | 29/33 |
| 3,546,029 | 1/1970 | Snyder et al. | 148/13.2 |
| 3,562,025 | 2/1971 | Snyder et al. | 148/13.2 |
| 3,659,830 | 5/1972 | Snyder et al. | 266/3 R |
| 3,859,132 | 1/1975 | Klasky | 134/2 |
| 3,986,378 | 10/1976 | Alekhin et al. | 72/38 |
| 4,040,863 | 8/1977 | Kitamura | 134/3 |
| 4,099,399 | 7/1978 | Berry et al. | 72/38 |
| 4,247,327 | 1/1981 | Plewes | 148/13.2 |

FOREIGN PATENT DOCUMENTS

| | | | |
|---|---|---|---|
| 1577179 | 10/1980 | United Kingdom | 148/13.2 |

*Primary Examiner*—Upendra Roy

*Attorney, Agent, or Firm*—James M. Rashid

[57] ABSTRACT

This invention relates to a method for removing an oxide scale from the surface of a hot rolled copper rod in an in-line process. The method comprises the steps of passing the rod through a chamber containing a reducing atmosphere, the chamber being immediately adjacent to the exit end of the rod rolling mill. The rod passes through the hydrogen containing chamber while it is still hot from the rolling operation, and the reducing atmosphere reduces the oxide scale to metallic copper. After passing through the chamber, the rod is cooled in an aqueous bath and then coiled.

3 Claims, 1 Drawing Sheet

HYDROGEN CLEANING OF HOT COPPER ROD

TECHNICAL FIELD

This invention relates to the field of copper rod production and more specifically to the in-line cleaning of hot rolled copper rod.

BACKGROUND

Copper is a widely used industrial material generally produced by melting a copper charge, casting the melted charge into a convenient intermediate form, and then either hot or cold working (or a combination of hot and cold working) the intermediate form into the desired product. Modern copper rod production facilities operate in a continuous fashion, with the speed of the rod at the end of the process being in the range of at least about 500 feet per minute (about 150 meters per minute). Copper is a chemically active material which tarnishes at room temperature and oxidizes more significantly at elevated temperatures. Thus, if hot working techniques are used to produce the copper product, and such techniques are performed in a oxidizing environment, oxides will form on the surface of the product, which must eventually be removed. It is known to remove such oxides mechanically by, for example abrasion or machining, or to remove such oxides in an acid bath, commonly referred to as pickling. Is also known that oxides can be removed by long time exposure to a gaseous reducing atmosphere, or by exposure to an aqueous alcohol solution.

A variety of gases have been suggested to reduce copper oxide. These include hydrogen and the various reducing gases produced by incomplete combustion of fuel. In general, cleaning of oxidized copper surfaces by treatment in a gaseous reducing atmosphere is performed in a batch type operation which can last several hours.

The removal of oxides from copper surfaces in a continuous process has been suggested by Snyder et al in U.S. Pat. No. 3,562,025; to avoid embrittling the copper rod, Snyder states that hydrogen should not be used in such a process. Snyder describes the use of a multi-step process, wherein the wire is first heated to a temperature below about 1,000° F. (about 540° C.) and is then inductively heated in a reducing atmosphere chamber to a temperature between about 1,100° and 1,400° F. (between about 595° and 760° C.) Related U.S. Pat. Nos. 3,546,029 and 3,659,830 also to Snyder relate to the gaseous cleaning of oxidized copper rod using reducing gases generated by incomplete combustion. These patents specify residence times of about one-half to five minutes in the reducing atmosphere, with rod velocities on the order of about three to twelve inches per minute (about 7.5 to 30 centimeters per minute). Such slow rod velocities are not practical in a state-of-the-art copper rod production facility.

Accordingly, there remains a need for a process to remove oxide layers from hot rolled copper rod on a continuous basis and at a velocity of more than 500 feet per minute (about 150 meters per minute).

DISCLOSURE OF THE INVENTION

According to the technique of the present invention, oxides on the surface of a copper rod are reduced to metallic copper immediately after hot rolling and while the rod is still at the temperature of the hot rolling operation. In particular, the rod is passed directly after hot rolling into a chamber essentially containing hydrogen or carbon monoxide gas of at least commercial purity, the rod passing through the chamber at a velocity in excess of about 500 feet per minute while being exposed to the reducing environment for a time which ranges from about one half to 5 seconds. Immediately after passing through the reducing environment the rod passes into an aqueous bath which cools the rod to a temperature below that at which significant surface oxidation can occur. Then, the cooled rod is coiled or passed directly to a subsequent production process.

The invention system is clean, safe, and economical, costing less than that of previously used techniques.

The foregoing, and other features and advantages of the invention will become more apparent from the following description and the accompanying drawing.

BEST MODE FOR CARRYING OUT THE INVENTION

In a modern copper rod producing facility, a continuously cast copper bar passes through a multistand rolling apparatus which reduces the as cast rod to a desired cross section. Commercially, the continuous casting and rolling operation is performed at rates which result in the copper rod moving at the rolling mill exit end at a speed of between about 500 and 1,500 feet per minute (between about 150 and 450 meters per minute).

The hot rolling process is generally performed at a temperature ranging from about 1,700° F. (about 930° C.) at the rolling mill inlet end to about 1,100° F. (about 595° C.) at rolling mill exit end, and is performed in air, which results in substantial oxidation of the copper during the rolling process. Since oxidation occurs between each stand in the multistand rolling mill, copper oxide which forms at the beginning of the rolling operation is rolled into the surface of the rod during subsequent rolling operations. This combination of oxidation and deformation results in a tenacious oxide layer on the rod surface at the rolling mill exit end. The oxide is typically on the order of about 15,000 angstroms in thickness. Adding to this surface contamination problem is the customary practice of spraying a mixture of water and a soluble oil onto the rolls and onto the copper rod during the rolling operation, in order to avoid adhesion of the copper and copper oxide to the rolls.

The problem solved by the present invention is that of removing the oxide, water, and oil contamination from the surface of the copper rod in an economical in-line process, without slowing the downstream speed of the rod.

Figure 1:
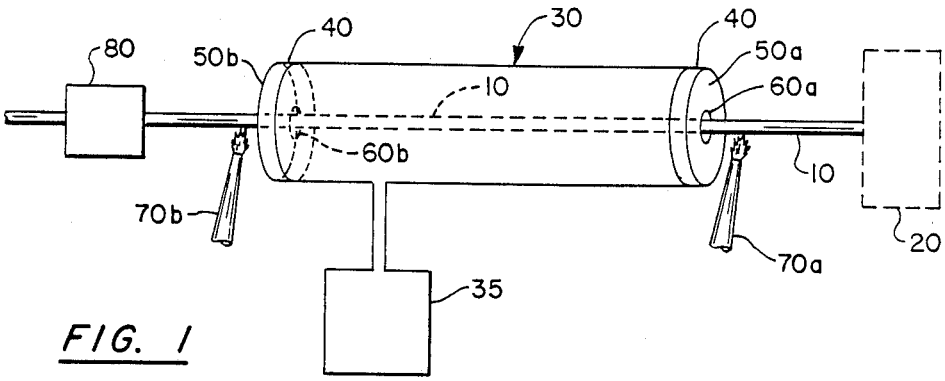
FIG. 1 is a schematic drawing showing apparatus useful in carrying out the invention process.

The invention is best understood with reference to FIG. 1. In the Figure, the downstream moving rod is represented with the reference numeral 10. After passing through the rolling mill indicated in phantom lines by the reference numeral 20, the rod 10 passes through a chamber 30 which contains a reducing atmosphere. The preferred atmosphere is gaseous hydrogen which has a dew point of less than about −75° F. (less than about −60° C.), supplied by tanks or any other suitable source 35. Carbon monoxide could also be used. The chamber 30 is generally cylindrical in shape, having caps 40 at each end 50*a*, 50*b*. Each cap 40 has a passageway 60*a*, 60*b*, of a diameter sufficient to allow the rod 10 to readily pass therethrough. The passageways 60*a*, 60*b* are also sized to accommodate any lateral deviation of the rod 10 (e.g., due to vibration) as it enters the chamber 30. To insure that the rod 10 is completely dry as it enters the chamber 30, a gas flame curtain 70*a* is located adjacent the entrance end 50*a* of the chamber to evaporate any moisture which may still be on the surface of the hot rolled rod 10. The flame curtain 70*a*, in conjunction with curtain 70*b*, also combusts any oxygen which may attempt to infiltrate the chamber 30.

To account for the time it takes for moisture on the rod surface to evaporate, the hydrogen reducing chamber 30 should be about three feet (slightly less than one meter) downstream of the rolling mill 20; this distance has been found to provide sufficient time to remove the majority of any moisture on the rod 10 by evaporation, when the rod is moving at standard production speeds. To prevent lubricating fluid from splashing from the rolling mill 20 onto the chamber 30, a deflector (not shown) may be incorporated between the mill 20 and chamber 30. Jets of air or other gases may also be used to blow the moisture from the surface of the rod between the last rolling mill and the hydrogen chamber.

The chamber 30 should be constructed such that the rod has a residence time in the chamber of about one half to about five seconds, depending on the amount of copper oxide to be removed; thin films of copper oxide will require a shorter residence time in the chamber 30 than will thick oxide films. Such a short residence time in the chamber 30 precludes hydrogen embrittlement of the rod when hydrogen as is used as the reducing agent in the chamber 30. After passing through the chamber 30, the rod passes into a cooling chamber 80 which reduces the temperature of the rod below that at which oxidation takes place which is about 300° F. (about 150° C).

Figure 2:
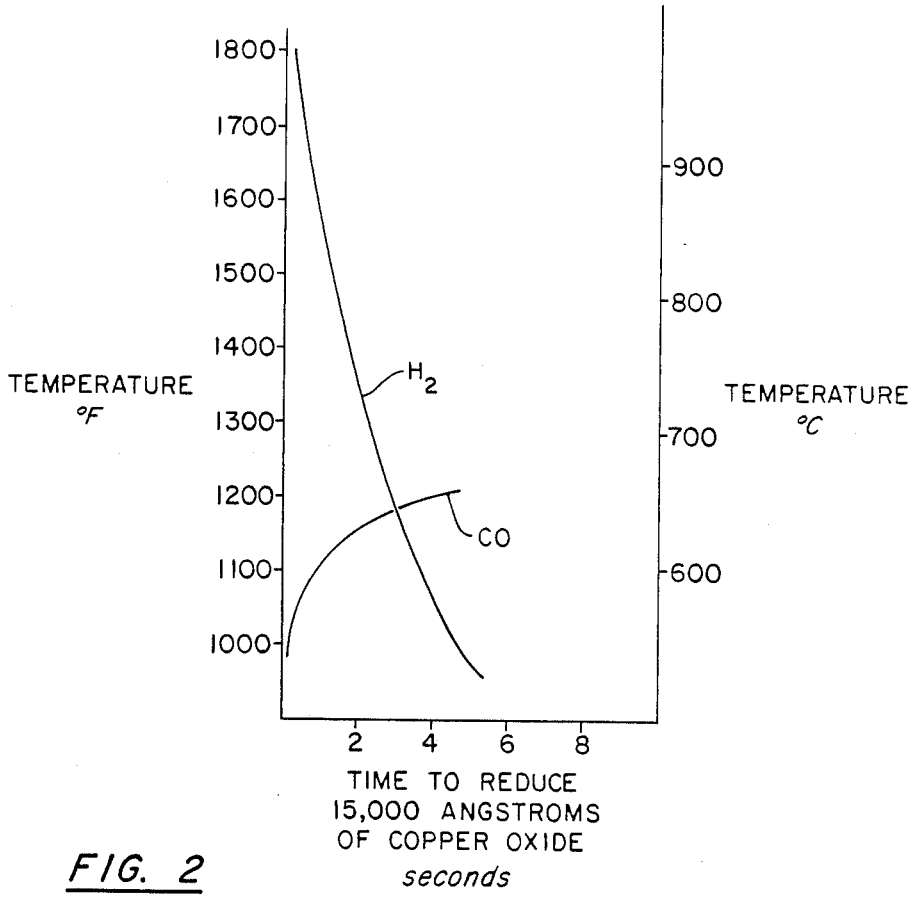
FIG. 2 shows the time required to remove about 15,000 angstroms of copper oxide from copper rod as a function of temperature, using the techniques of the present invention.

FIG. 2 shows the time required to remove about 15,000 angstroms of copper oxide in various hydrogen and carbon monoxide environments maintained at temperatures between about 1,000° and 1,700° F. (between about 540° and 930° C.). The Figure shows that at relatively low temperatures (up to about 1,200° F.), the use of commercially pure carbon monoxide is preferred for reducing copper oxide. At higher temperatures, hydrogen rich atmospheres are preferred. This data therefore shows that the reducing process can be tailored to utilize the most efficient reducing atmosphere depending on the rod temperature. This is in contrast to the prior practice of using any convenient reducing medium without regard for the efficiency. As a result, the prior practice was not necessarily the most economical.

EXAMPLE

This invention was evaluated with a continuous casting and rolling copper rod facility which produced about 20,000 pounds (about 9,100 kilograms) of copper rod per hour, the rod having a diameter of about ⅜ inch (about 0.9 centimeter). At the exit end of the mill stand, the copper rod was moving at a speed of about 800 feet per minute (about 245 meters per minute), and had an oxide scale which was estimated as being in the range of about 15,000 angstroms in thickness. The ultimate intended application for the rod required that the surface oxide thickness be reduced to less than about 1,000 angstroms in thickness. Removal of the excess oxide scale was accomplished with the use of a hydrogen reducing chamber in the manner described above. The chamber was cylindrical in shape, about 14 feet (about 4.25 meters) long and about 2½ inches (about 6.4 centimeters) in diameter. The ends of the chamber were capped, and ½ inch (1.25 centimeter) diameter holes were present in each cap to allow for the entrance and exit of the rod. The chamber was connected to a source which flowed commercially pure hydrogen gas into the chamber at a rate of about 88 cubic feet (about 2,500 liters) per hour.

In operation, the rod entered the chamber at a temperature of about 1,100° F. (about 595° C.) and passed through the chamber with a residence time of about 1.05 seconds, during which time the hydrogen atmosphere reduced the surface oxide on the rod to metallic (pure) copper. It was determined that the flow rate of hydrogen into the chamber was also sufficient to eliminate the infiltration of the ambient (air) atmosphere; it was also sufficient to compensate for the amount of hydrogen consumed in the reduction process, and to carry any water vapor from the chamber. Also the amount of hydrogen was found to be nonhazardous.

Immediately upon exiting the chamber, the rod passed through a cooling fluid bath which essentially contained water, and which reduced the temperature of the rod to below about 300° F. (about 150° C.), a temperature at which substantial oxidation of the copper does not take place. Then the rod was coiled in a conventional manner.

The process of this invention is capable of treating copper rod moving at speeds of at least about 500 feet per second, thereby making it practical for use with modern high speed copper rod processing systems. This invention system produces a better quality copper rod than the prior art systems, at a lower cost, and presents no health or safety problems.

Although this invention has been shown and described with respect to a detailed embodiment thereof, it will be understood by those skilled in the art that various changes in form and detail thereof may be made without departing from the spirit and scope of the claimed invention.

I claim:

1. A method for reducing copper oxides on the surface of a copper rod produced in a continuous casting and hot rolling operation, comprising the steps of drying the rod surface, passing the dry rod at a speed of at least about 500 feet per minute and a temperature of at least about 1,100° F. through a chamber containing a reducing gas environment consisting essentially of hydrogen gas, and then passing the rod through a cooling chamber to cool the rod to a temperature below about 300° F., wherein the residence time of the rod in the reducing chamber is about one half to five seconds, the dew point in the chamber is less than about −75° F., and the reducing gas is flowed into the chamber at a rate sufficient to prevent the infiltration of ambient atmosphere into the chamber.

2. The process of claim 1, wherein the rod moves through a gaseous hydrogen atmosphere at a speed of at least about 800 feet per minute, and at a temperature in the hydrogen atmosphere of at least about 1,100° F.

3. A method for reducing copper oxides on the surface of a copper rod produced in a continuous casting and hot rolling operation, comprising the steps of drying the rod surface, passing the dry rod at a speed of at least about 500 feet per minute and a temperature of between about 1,000° and 1,200° F. through a chamber containing a reducing gas environment consisting essentially of carbon monoxide gas, and then passing the rod through a cooling chamber to cool the rod to a temperature below about 300° F., wherein the residence time of the rod in the reducing chamber is about one half to five seconds, the dew point in the chamber is less than about −75° F., and the reducing gas is flowed into the chamber at a rate sufficient to prevent the infiltration of ambient atmosphere into the chamber.

* * * * *